United States Patent [19]

Sageman et al.

[11] 4,443,229

[45] Apr. 17, 1984

[54] GASIFICATION PROCESS FOR CARBONACEOUS MATERIALS

[75] Inventors: David Sageman; David S. Mitchell, both of San Rafael, Calif.

[73] Assignee: Chevron Research Company, San Francisco, Calif.

[21] Appl. No.: 462,161

[22] Filed: Jan. 31, 1983

[51] Int. Cl.[3] ..... C10J 3/46; C10J 3/54

[52] U.S. Cl. ..... 48/197 R; 48/202

[58] Field of Search ..... 48/197 R, 202, 206, 48/210, DIG. 4; 252/373

[56] References Cited

U.S. PATENT DOCUMENTS 4,154,581 5/1979 Nack et al. ..... 48/206

4,157,245 6/1979 Mitchell et al. ..... 48/DIG. 4

*Primary Examiner*—Peter F. Kratz

*Attorney, Agent, or Firm*—D. A. Newell; S. R. LaPaglia; E. A. Schaal

[57] ABSTRACT

A coal gasification process is disclosed wherein two portions of heat transfer material are introduced into the reaction vessel at different locations and different temperatures. Steam is passed upwardly through the vessel to react with the carbonaceous material to form a hot char and a gaseous product, wherein the heat necessary for the coal gasification reaction is supplied by both the first portion of heat transfer material and the second portion of heat transfer material. Then the hot char and gaseous product are cooled by contact with the first portion of heat transfer material.

7 Claims, 1 Drawing Figure

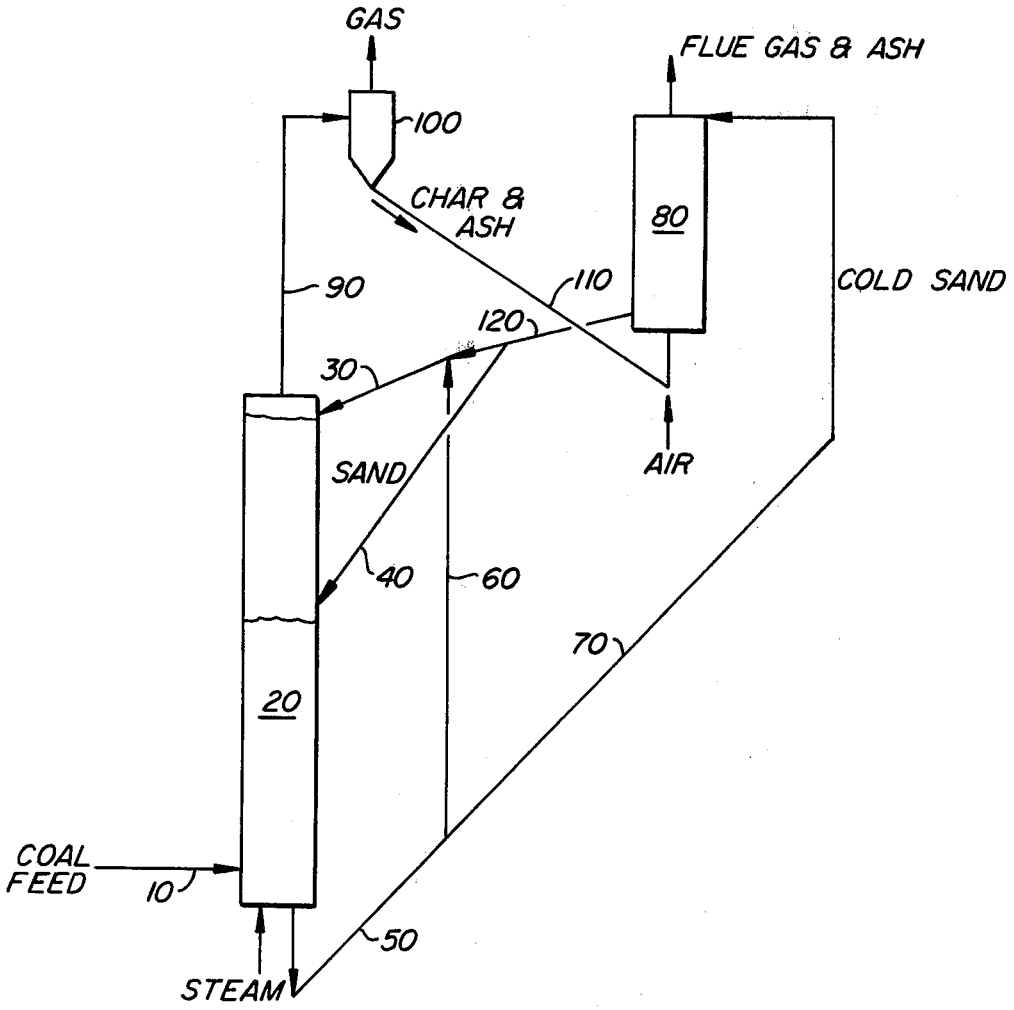
GAS
FLUE GAS & ASH
100
CHAR & ASH
80
90
110
COLD SAND
120
30
SAND
AIR
40
60
70
20
COAL FEED
10
50
STEAM

GASIFICATION PROCESS FOR CARBONACEOUS MATERIALS

BACKGROUND OF THE INVENTION

The present invention involves an improved method for gasification of carbonaceous materials.

In view of recent increases in the price of crude oil, researchers have been searching for alternative sources of energy and hydrocarbons. Much research has focused on recovering the hydrocarbons from hydrocarbon-containing solids such as shale, tar sand or coal by heating or pyrolysis to boil off or liquefy the hydrocarbons trapped in the solid or by reacting the solid with steam, for example, to convert components of solid carbonaceous material into more readily usable gaseous and liquid hydrocarbons. Other known processes involve combustion of the solid carbonaceous materials with an oxygen-containing gas to generate heat. Such processes conventionally employ a treatment zone, e.g., a reaction vessel, in which the solid is heated or reacted.

In a typical coal gasification process, coal is contacted with steam and an oxygen-containing gas to produce a gaseous product.

When air is used as the oxygen-containing gas, the gaseous product contains high levels of nitrogen, which reduces the BTU content of the gaseous product. Some processes have used pure oxygen instead of air, in order to avoid having nitrogen in the gaseous product. This does eliminate the nitrogen from the product but it requires a source of pure oxygen, some oxygen plants are almost as large as the coal gasification plant they are supplying. Thus, one was faced with the alternatives of either producing a gaseous product diluted with nitrogen or finding a source of pure oxygen for their process.

Another solution to the nitrogen dilution problem is disclosed in U.S. Pat. No. 4,157,245. In one embodiment of the invention disclosed in that patent, a solid heat-transfer material, such as sand, is introduced into an upper portion of a reaction vessel and coal is introduced into a lower portion of the vessel. The physical characteristics of the heat-transfer material and the coal differ such that a superficial velocity of a fluid flowing upwardly through the vessel is greater than the minimum fluidizing velocity of the heat-transfer material and the terminal velocity of the coal, but is less than the terminal velocity of the heat-transfer material. A substantially countercurrent vertical flow of the two solids is maintained in the vessel without substantial top-to-bottom backmixing by passing steam upwardly through the vessel at a rate sufficient to fluidize the heat-transfer material and entrain the coal whereby the heat-transfer material substantially flows downwardly in a fluidized state through the vessel and the coal substantially flows upwardly in an entrained state through the vessel. The steam reacts with the coal to form a hot char and a gaseous product. The heat-transfer material acts as a source of heat for the reaction between the steam and the coal. Cooled heat-transfer material is removed from a lower end of the vessel and the hot char and the gaseous product are removed from an upper end of the vessel. The gaseous product is then separated from the hot char by regular separation techniques.

In one method, the heat-transfer material can be heated by introducing it into an upper portion of a combustion zone, introducing the hot char into a lower portion of the zone, and contacting the heat-transfer material with the hot char while maintaining substantially countercurrent plug flow of the two solids by passing air upwardly through the combustion zone at a rate sufficient to fluidize the heat-transfer material and entrain the char. The heat-transfer material substantially flows downwardly through the combustion zone in a fluidized state and is heated while the char substantially flows upwardly through the combustion zone in an entrained state and is combusted.

The process in U.S. Pat. No. 4,157,245 is based in part on the discovery that in the typical coal gasification process, there are two separate reactions occurring in the same vessel: (1) an endothermic reaction between the coal and steam which produces the gaseous product, and (2) an exothermic reaction between the coal and the oxygen-containing gas which produces the heat necessary for the first reaction. The process of U.S. Pat. No. 4,157,245 separates these two reactions in two separate vessels and transfers the heat generated by the second reaction to the site of the first reaction via a heat-transfer material.

A major advantage of this process is that air can be used as the oxidizing gas without causing the resulting gaseous product to be diluted with nitrogen.

One problem associated with the gasification of coal is that the hot char and gaseous product leaves the reaction vessel at a high temperature, and must be cooled prior to further processing.

Various heat exchange systems have been proposed to cool the exiting gases, but these systems require that the heat exchangers be made of exotic metal alloys in order for the materials to withstand these high temperatures and the corrosion that results because of the gas having particulates at such high temperature.

SUMMARY OF THE INVENTION

The present invention overcomes the deficiencies of the prior art by introducing two portions of heat transfer material into the reaction vessel at different locations and different temperatures. A first portion of solid heat transfer material is introduced into an upper portion of the vessel and a second portion of the heat transfer material is introduced into a middle portion of the vessel. The second portion of heat transfer material is intorduced into the vessel at a higher temperature than the first portion of heat transfer material. A carbonaceous material is introduced into a lower portion of the reaction vessel, then steam is passed upwardly through the vessel to react with the carbonaceous material in the lower portion to form a hot char and a gaseous product, wherein the heat necessary for the coal gasification reaction is supplied by both the first portion of heat transfer material and the second portion of heat transfer material. Then the hot char and gaseous product are cooled by contact with the first portion of heat transfer material. The hot char and the gaseous product is removed from an upper end of the reaction vessel and the heat transfer material is removed from a lower end of the vessel. An advantage of this process is that the heat removed in the upper portion of the reaction vessel can be used to heat incoming carbonaceous material in the lower portion of the reaction vessel.

Preferably, some of the heat transfer material is recycled from the lower end of the vessel to the upper portion of the reaction vessel as a source of the first portion of heat transfer material; the remaining heat transfer material is heated; and at least a portion of the heated heat transfer material is recycled to the middle portion of the vessel as a source of the second portion of heat transfer material and to the upper portion of the reaction vessel as a source of the first portion of heat transfer material, wherein the heated heat transfer material and the heat transfer material recycled directly from the bottom of the reaction vessel are mixed together before being introduced in the upper portion of the vessel as a source of the first portion of heat transfer material.

A preferred method of heating the heat transfer material is introducing the heat transfer material to be heated into an upper portion of a combustion zone; separating the hot char from the gaseous product and introducing at least a portion of the hot char into a lower portion of the combustion zone; and heating the heat transfer material to an elevated temperature in the combustion zone by contacting the heat transfer material with the hot char as air is passed upwardly through the combustion zone, whereby the heat transfer material is heated to an elevated temperature while the char is combusted.

Preferably, the carbonaceous material is coal; the first portion of heat transfer material is introduced into the upper portion of the vessel at a temperature of between 500° F. and 2000° F.; and the second portion of heat transfer material is introduced into the middle portion of the vessel at a temperature of about 2000° F.

BRIEF DESCRIPTION OF THE DRAWING

In order to facilitate the understanding of this invention, reference will now be made to the appended drawing of a preferred embodiment of the invention. The drawing should not be construed as limiting the invention but is exemplary only. It is a process diagram of a preferred embodiment of the invention.

DESCRIPTION OF THE PREFERRED EMBODIMENTS

In its broadest aspect, the present invention involves the use of unheated heat transfer material to cool the hot char and gaseous product prior to their leaving the reaction vessel.

Advantages of this process include the ability to use common materials in downstream equipment, which means that less expensive equipment can be used; and the fact that the heat is kept inside the reaction vessel, which means a more energy-efficient process.

Referring to the drawing, a coal is introduced via line 10 into a lower portion of a vertically elongated reaction vessel 20, said vessel having a means for substantially impeding vertical backmixing of vertically moving solids in the vessel. A first portion of sand is introduced via line 30 into an upper portion of vessel 20 at a temperature of between 500° F. and 2000° F. and a second portion of sand is introduced via line 40 at a temperature of about 2000° F. into a middle portion between upper portion and lower portion of vessel. The physical characteristics of the sand and the coal differ such that a superficial velocity of a fluid flowing upwardly through the vessel is greater than the minimum fluidizing velocity of the sand and the terminal velocity of the coal, but is less than the terminal velocity of the sand. Steam is passed upwardly through vessel 20 at a rate sufficient to fluidize the sand and entrain the coal to maintain substantially countercurrent vertical flow of the sand and coal in the vessel without substantial top-to-bottom backmixing of the sand and the coal in the vessel. The sand substantially flows downwardly in a fluidized state through vessel 20 and the coal substantially flows upwardly in an entrained state through the vessel, whereby the steam reacts with the coal in lower portion of reaction vessel to form a hot char and a gaseous product. The heat necessary for reaction is supplied by both the first portion of sand and the second portion of sand. The hot char and gaseous product are cooled in the upper portion by contacting the hot char and gaseous product with the first portion of sand. All of the sand is removed via line 50 from a lower end of vessel 20 at a temperature substantially lower than the lowest temperature at which the heat transfer material was introduced into the vessel.

Some of the sand is recycled via line 60 to the upper portion of reaction vessel as a source of first portion of sand. The remaining sand is introduced via line 70 into an upper portion of a vertically elongated combustion zone 80 having means for substantially impeding vertical backmixing of vertically moving solids substantially throughout the combustion zone. The hot char and the gaseous product are removed from an upper end of reaction vessel 20 via line 90, the hot char is separated from the gaseous product in separator 100, and at least a portion of the hot char is introduced via line 110 into a lower portion of the combustion zone 80. The sand is heated in combustion zone 80 to an elevated temperature by contacting the sand with the hot char while maintaining substantially countercurrent plug flow of the sand and the char by passing air upwardly through the combustion zone at a rate sufficient to fluidize the heat transfer material and entrain the char, whereby the sand substantially flows downwardly through the combustion zone in a fluidized state and is heated to an elevated temperature while the char substantially flows upwardly through the combustion zone in an entrained state and is combusted. At least a portion of sand from combustion zone 80 is recycled via line 120 and mixed with the sand recycled directly from the bottom of the reaction vessel 20 via line 60, then the mixture is introduced via line 30 in the upper portion of vessel 20 as a source of first portion of heat transfer material. Another portion of sand from combustion zone 80 is recycled via lines 120 and 40 to the middle portion of vessel as a source of second portion of sand.

A major advantage of the first portion of sand cooling the hot char and gaseous product is that the heat lost to the sand can be used to heat incoming coal in the lower portion of the vessel. This means that this heat remains in the vessel, resulting in a more energy-efficient system.

The present invention can be used in the processes disclosed in U.S. Pat. No. 4,157,245. U.S. Pat. No. 4,157,245 is hereby incorporated by reference to disclose a coal gasification process which can be benefited by this process.

In one particular embodiment of the present invention, one portion of sand is introduced at a temperature of beween 500° F. anmd 2000° F. into an upper portion of a vertically elongated reaction vessel which has a means for substantially impeding vertical backmixing of vertically moving solids in the vessel. Also introduced into an upper portion of the vessel is any sand that is recycled from the combustion zone. Another portion of sand is introduced at a temperature of about 2000° F. into a middle portion of the reaction vessel. Coal is introduced into a lower portion of the vessel. The physical characteristics of the sand and the coal must differ such that a superficial velocity of a fluid flowing upwardly through the vessel is greater than the minimum fluidizing velocity of the sand and the terminal velocity of the coal, but is less than the terminal velocity of the sand.

Then steam is passed upwardly through the vessel at a rate sufficient to fluidize the sand and entrain the coal to maintain substantially countercurrent flow of the sand and coal in the vessel without substantial top-to-bottom backmixing of the sand and the coal in the vessel. The sand substantially flows downwardly in a fluidized state through the vessel. The coal substantially flows upwardly in an entrained state through the vessel and the steam reacts with the coal to form a hot char and a gaseous product. Then the hot char and gaseous product are cooled by the first portion of sand. The sand is removed from a lower end of the vessel at a temperature substantially lower than the lowest temperature at which the sand was introduced into the vessel. Some of the sand is recycled to the upper portion of the vessel as a source of the first portion of sand. The hot char and the gaseous product are removed from an upper end of the vessel, and the hot char is separated from the gaseous product.

In the second part of this embodiment, the remaining sand is introduced into an upper portion of a vertically elongated combustion zone having means for substantially impeding vertical backmixing of vertically moving solids substantially throughout the combustion zone. A portion of the hot char is introduced into a lower portion of the combustion zone. The sand is heated to an elevated temperature in the combustion zone by contacting the sand with the hot char while maintaining substantially countercurrent plug flow of the sand and the char by passing air upwardly through the combustion zone at a rate sufficient to fluidize the sand and entrain the char. The sand substantially flows downwardly through the combustion zone in a fluidized state and is heated to an elevated temperature while the char substantially flows upwardly through the combustion zone in an entrained state and is combusted. At least a portion of sand from the combustion zone is recycled and mixed with the sand recycled directly from the bottom of the reaction vessel, then the mixture is introduced in the upper portion of vessel as a source of first portion of heat transfer material. The two heat transfer materials can be mixed by any conventional means, such as passing the two materials through a valve, a mixer, or a static mixer. Another portion of sand from combustion zone is recycled to the middle portion of vessel as a source of second portion of sand.

The exit temperature of the hot char and gaseous product can be controlled by adjusting the relative amounts of heated heat transfer material in the first portion of heat transfer material. The exit temperature should preferably be between 500° and 800° F. At much lower temperatures, carbonic acid begins to form.

Although the above embodiment deals with the gasification of coal, this process can be used for the gasification of other carbonaceous materials such as organic char and coke products. Also, catalysts can be incorporated into the coal to catalyze the gasification reaction. The use of such catalysts as alkali metal compounds are well known in the art. Also, sulfur getters, such as compounds of alkaline earth metals, can also be incorporated into the coal in this process to remove any sulfur generated by the process.

The downflowing particulate solid heat transfer materials can be reactive, inert, or comprise a mixture or composite of reactive and inert materials. Preferably, however, the downflowing solid is inert and preferably in the form of granules, balls, or pellets. A particularly preferred heat transfer material is sand.

While the present invention has been described with reference to specific embodiments, this application is intended to cover those various changes and substitutions which may be made by those skilled in the art without departing from the spirit and scope of the appended claims.

What is claimed is:

1. A method for gasification of a carboanceous material comprising:

(a) introducing a carbonaceous material into a lower portion of a reaction vessel;

(b) introducing a first portion of solid heat transfer material into an upper portion of said vessel and introducing a second portion of said heat transfer material into a middle portion of said vessel, wherein the second portion of heat transfer material is introduced into said vessel at a higher temperature than the first portion of heat transfer material;

(c) passing steam upwardly through said vessel to react with the carbonaceous material in said lower portion of said reaction vessel to form a hot char and a gaseous product, wherein the heat necessary for said reaction is supplied by both the first portion of heat transfer material and the second portion of heat transfer material;

(d) cooling the hot char and gaseous product in the upper portion by contact with the first portion of heat transfer material;

(e) removing the hot char and the gaseous product from an upper end of said reaction vessel; and (f) removing the heat transfer material from a lower end of said vessel.

2. A method for gasification of a carbonaceous material according to claim 1 comprising the additional steps of:

(g) recycling some of the heat transfer material from the lower end of said vessel to the upper portion of said reaction vessel as a source of said first portion of heat transfer material;

(h) heating the remaining heat transfer material; and (i) recycling at least a portion of said heated heat transfer material to the middle portion of said vessel as a source of said second portion of heat transfer material and to said upper portion of said reaction vessel as a source of said first portion of heat transfer material, wherein the heated heat transfer material and the heat transfer material recycled directly from the bottom of the reaction vessel are mixed together before being introduced in the upper portion of said vessel as a source of said first portion of heat transfer material.

3. A method for gasification of a carbonaceous material according to claim 2 wherein said heated heat transfer material is heated by the steps comprising:

(j) introducing the heat transfer material to be heated into an upper portion of a combustion zone;

(k) separating the hot char from the gaseous product and introducing at least a portion of said hot char into a lower portion of the combustion zone; and (l) heating the heat transfer material to an elevated temperature in said combustion zone by contacting the heat transfer material with the hot char as air is passed upwardly through the combustion zone, whereby the heat transfer material is heated to an elevated temperature while the char is combusted.

4. A method for gasification of a carbonaceous material according to claim 1 wherein said carbonaceous material is coal.

5. A method for gasification of a carbonaceous material according to claim 1 wherein said first portion of heat transfer material is introduced into said upper portion of said vessel at a temperature of between 500° F. and 2000° F.

6. A method for gasification of a carbonaceous material according to claim 1 wherein said second portion of heat transfer material is introduced into said middle portion of said vessel at a temperature of about 2000° F.

7. A method for gasification of a carbonaceous material comprising:

(a) introducing a coal into a lower portion of a vertically elongated reaction vessel, the vessel having a means for substantially impeding vertical backmixing of vertically moving solids in the vessel;

(b) introducing a first portion of solid heat transfer material into an upper portion of said vessel at a temperature of between 500° F. and 2000° F. and introducing a second portion of said heat transfer material at a temperature of about 2000° F. into a middle portion between said upper portion and said lower portion of said vessel, wherein the second portion of heat transfer material is introduced into said vessel at a higher temperature than the first portion of heat transfer material, the physical characteristics of the heat transfer material and the coal differing such that a superficial velocity of a fluid flowing upwardly through the vessel is greater than the minimum fluidizing velocity of the heat transfer material and the terminal velocity of the coal, but is less than the terminal velocity of the heat transfer material;

(c) passing steam upwardly through said vessel at a rate sufficient to fluidize the heat transfer material and entrain the coal to maintain substantially countercurrent vertical flow of the heat transfer material and coal in the vessel without substantial top-to-bottom backmixing of the heat transfer material and the coal in the vessel, whereby the heat transfer material substantially flows downwardly in a fluidized state through the vessel and the coal substantially flows upwardly in an entrained state through the vessel, whereby the steam reacts with the coal in said lower portion of said reaction vessel to form a hot char and a gaseous product, wherein the heat necessary for said reaction is supplied by both the first portion of heat transfer material and the second portion of heat transfer material and wherein the hot char and gaseous product are cooled in the upper portion by contacting the hot char and gaseous product with the first portion of heat transfer material;

(d) removing all of the heat transfer material from a lower end of said vessel at a temperature substantially lower than the lowest temperature at which the heat transfer material was introduced into the vessel;

(e) recycling some of the heat transfer material to the upper portion of said reaction vessel as a source of said first portion of heat transfer material;

(f) introducing the remaining heat transfer material into an upper portion of a vertically elongated combustion zone having means for substantially impeding vertical backmixing of vertically moving solids substantially throughout the combustion zone;

(g) removing the hot char and the gaseous product from an upper end of said reaction vessel, separating the hot char from the gaseous product, and introducing at least a portion of said hot char into a lower portion of the combustion zone;

(h) heating the zone transfer material in said combustion zone to an elevated temperature by contacting the heat transfer material with the hot char while maintaining substantially countercurrent plug flow of the heat transfer material and the char by passing air upwardly through the combustion zone at a rate sufficient to fluidize the heat transfer material and entrain the char, whereby the heat transfer material substantially flows downwardly through the combustion zone in a fluidized state and is heated to an elevated temperature while the char substantially flows upwardly through the combustion zone in an entrained state and is combusted; and (i) recycling at least a portion of said heat transfer material from said combustion zone to said upper portion of said reaction vessel as a source of said first portion of heat transfer material and to the middle portion of said vessel as a source of said second portion of heat transfer material, wherein the heat transfer material material from the combustion zone and the heat transfer material recycled directly from the bottom of the reaction vessel are mixed together before being introduced in the upper portion of said vessel as a source of said first portion of heat transfer material.

* * * * *